US009238782B2

(12) United States Patent
Senior et al.

(10) Patent No.: US 9,238,782 B2
(45) Date of Patent: Jan. 19, 2016

(54) PROCESS TO REDUCE EMISSIONS OF NITROGEN OXIDES AND MERCURY FROM COAL-FIRED BOILERS

(71) Applicants: Constance Senior, Salt Lake City, UT (US); Gregory M. Filippelli, Catonsville, MD (US); Cynthia Jean Bustard, Littleton, CO (US); Michael D. Durham, Castle Rock, CO (US); William J. Morris, Evergreen, CO (US); Sharon M. Sjostrom, Castle Rock, CO (US)

(72) Inventors: Constance Senior, Salt Lake City, UT (US); Gregory M. Filippelli, Catonsville, MD (US); Cynthia Jean Bustard, Littleton, CO (US); Michael D. Durham, Castle Rock, CO (US); William J. Morris, Evergreen, CO (US); Sharon M. Sjostrom, Castle Rock, CO (US)

(73) Assignee: ADA-ES, Inc., Highlands Ranch, CO (US)

( * ) Notice: Subject to any disclaimer, the term of this patent is extended or adjusted under 35 U.S.C. 154(b) by 0 days.

(21) Appl. No.: 14/484,001

(22) Filed: Sep. 11, 2014

(65) Prior Publication Data

US 2015/0000187 A1 Jan. 1, 2015

Related U.S. Application Data

(62) Division of application No. 13/471,015, filed on May 14, 2012, now Pat. No. 8,845,986.

(60) Provisional application No. 61/486,217, filed on May 13, 2011, provisional application No. 61/543,196, filed on Oct. 4, 2011.

(51) Int. Cl.

| | |
|---|---|
| ***C10L 9/10*** | (2006.01) |
| ***F23J 7/00*** | (2006.01) |
| ***F23J 15/00*** | (2006.01) |

(52) U.S. Cl.
CPC .... *C10L 9/10* (2013.01); *F23J 7/00* (2013.01); *F23J 15/003* (2013.01); *F23K 2201/505* (2013.01); *Y10T 428/2982* (2015.01)

(58) Field of Classification Search
CPC ..... B01D 20/027; B01J 20/046; C09K 3/00; C10L 53/32; C10L 1/10; C10L 9/10
USPC ..... 252/184, 189, 190; 44/620, 621
See application file for complete search history.

(56) References Cited

U.S. PATENT DOCUMENTS

| | | | | |
|---|---|---|---|---|
| 4,212,853 | A * | 7/1980 | Fukui | 423/235 |
| 4,678,481 | A | 7/1987 | Diep | |
| 4,681,687 | A | 7/1987 | Mouche | |
| 4,758,371 | A | 7/1988 | Bhatia | |
| 4,886,872 | A | 12/1989 | Fong | |

(Continued)

FOREIGN PATENT DOCUMENTS

| | | | |
|---|---|---|---|
| RU | 2515988 C2 * | 5/2014 | C10L 10/00 |
| WO | WO 2006/091635 | 8/2006 | |

OTHER PUBLICATIONS

Jeong et al. "Nox Removal by Selective Noncatalytic Reduction with Urea Solution in a Fluidized Bed Reactor," Korean Journal of Chemical Engineering, Sep. 1999, vol. 16, No. 5, pp. 614-617.

(Continued)

*Primary Examiner* — Timothy Vanoy
(74) *Attorney, Agent, or Firm* — Sheridan Ross P.C.

(57) ABSTRACT

A flue gas additive is provided that includes both a nitrogenous component to reduce gas phase nitrogen oxides and a halogen-containing component to oxidize gas phase elemental mercury.

20 Claims, 6 Drawing Sheets

(56) References Cited

U.S. PATENT DOCUMENTS

| | | | | |
|---|---|---|---|---|
| 4,992,209 | A | 2/1991 | Smyk | |
| 5,037,579 | A | 8/1991 | Matchett | |
| 5,047,219 | A | 9/1991 | Epperly | |
| 5,277,135 | A | 1/1994 | Dubin | |
| 5,387,393 | A | 2/1995 | Braden | |
| 5,415,783 | A | 5/1995 | Johnson | |
| 5,648,508 | A | 7/1997 | Yaghi | |
| 6,083,403 | A | 7/2000 | Tang | |
| 6,348,178 | B1 | 2/2002 | Sudduth et al. | |
| 6,572,789 | B1 | 6/2003 | Yang | |
| 6,682,709 | B2 | 1/2004 | Sudduth et al. | |
| 6,694,900 | B2 | 2/2004 | Lissianski et al. | |
| 6,702,569 | B2 | 3/2004 | Kobayashi et al. | |
| 6,729,248 | B2 | 5/2004 | Johnson et al. | |
| 6,740,133 | B2 | 5/2004 | Hundley, Jr. | |
| 6,761,868 | B2 | 7/2004 | Brooks et al. | |
| 6,773,471 | B2 | 8/2004 | Johnson et al. | |
| 6,860,911 | B2 | 3/2005 | Hundley | |
| 6,883,444 | B2 | 4/2005 | Logan et al. | |
| 6,953,494 | B2 | 10/2005 | Nelson, Jr. | |
| 7,008,603 | B2 | 3/2006 | Brooks et al. | |
| 7,013,817 | B2 | 3/2006 | Stowe, Jr. et al. | |
| 7,111,591 | B2 | 9/2006 | Schwab et al. | |
| 7,217,401 | B2 | 5/2007 | Ramme et al. | |
| 7,332,002 | B2 | 2/2008 | Johnson et al. | |
| 7,430,969 | B2 | 10/2008 | Stowe, Jr. et al. | |
| 7,497,076 | B2 | 3/2009 | Funk et al. | |
| 7,651,541 | B2 | 1/2010 | Hundley et al. | |
| 7,674,442 | B2 | 3/2010 | Comrie | |
| 7,712,306 | B2 | 5/2010 | White et al. | |
| 7,758,827 | B2 | 7/2010 | Comrie | |
| 7,776,301 | B2 | 8/2010 | Comrie | |
| 7,862,630 | B2 * | 1/2011 | Hundley et al. | 44/641 |
| 7,906,090 | B2 * | 3/2011 | Ukai et al. | 423/210 |
| 7,955,577 | B2 | 6/2011 | Comrie | |
| 7,988,939 | B2 | 8/2011 | Comrie | |
| 8,124,036 | B1 | 2/2012 | Baldrey et al. | |
| 8,293,196 | B1 | 10/2012 | Baldrey et al. | |
| 8,372,362 | B2 | 2/2013 | Durham et al. | |
| 8,845,986 | B2 | 9/2014 | Senior et al. | |
| 2003/0192234 | A1 | 10/2003 | Logan et al. | |
| 2003/0196578 | A1 | 10/2003 | Logan et al. | |
| 2003/0226312 | A1 | 12/2003 | Roos et al. | |
| 2006/0090678 | A1 | 5/2006 | Kriech | |
| 2007/0281253 | A1 | 12/2007 | Toqan | |
| 2008/0017337 | A1 | 1/2008 | Duggirala | |
| 2009/0148372 | A1 | 6/2009 | Keiser | |
| 2009/0287013 | A1 | 11/2009 | Morrison | |
| 2010/0189617 | A1 | 7/2010 | Hundley et al. | |
| 2010/0189618 | A1 | 7/2010 | White et al. | |
| 2011/0262873 | A1 * | 10/2011 | Nalepa et al. | 431/2 |
| 2012/0100053 | A1 | 4/2012 | Durham et al. | |
| 2012/0216729 | A1 | 8/2012 | Baldrey et al. | |
| 2012/0311924 | A1 * | 12/2012 | Richardson et al. | 44/604 |
| 2013/0276682 | A1 | 10/2013 | Durham | |
| 2014/0041561 | A1 | 2/2014 | Morris et al. | |
| 2014/0202069 | A1 * | 7/2014 | Aradi et al. | 44/359 |

OTHER PUBLICATIONS

McCoy "Urea's Unlikely Role: Emissions Reduction is new application for chemical best known as a fertilizer," Chemical and Engineering News, Jun. 6, 2011, vol. 89, No. 23, p. 32.

Official Action for U.S. Appl. No. 13/471,015, mailed Nov. 13, 2013 Restriction Requirement.

Official Action for U.S. Appl. No. 13/471,015, mailed Jan. 21, 2014 Restriction Requirement.

Notice of Allowance for U.S. Appl. No. 13/471,015, mailed May 23, 2014 10 pages.

* cited by examiner

PROCESS TO REDUCE EMISSIONS OF NITROGEN OXIDES AND MERCURY FROM COAL-FIRED BOILERS

CROSS REFERENCE TO RELATED APPLICATION

The present application is a divisional of U.S. application Ser. No. 13/471,015, filed May 14, 2012, now U.S. Pat. No. 8,845,986, which claims the benefits of U.S. Provisional Application Ser. No. 61/486,217, filed May 13, 2011, and Ser. No. 61/543,196, filed Oct. 4, 2011, of the same title, each of which is incorporated herein by this reference in its entirety.

FIELD

The disclosure relates generally to removal of contaminants from gases and particularly to removal of mercury and nitrogen oxides from flue gases.

BACKGROUND

A major source of environmental pollution is the production of energy. While research into alternative, cleaner sources of energy has grown, the vast majority of the energy produced in the world is still obtained from fossil fuels such as coal, natural gas and oil. In fact, in 2005, 75% of the world's energy was obtained from fossil fuels (Environmental Literacy Council). Of these fossil fuels, coal provides 27% of the world's energy and 41% of the world's electricity. Thus, there is also increased interest in making current energy producing processes more environmentally friendly (i.e., cleaner).

Coal is an abundant source of energy. Coal reserves exist in almost every country in the world. Of these reserves, about 70 countries are considered to have recoverable reserves (World Coal Association). While coal is abundant, the burning of coal results in significant pollutants being released into the air. In fact, the burning of coal is a leading cause of smog, acid rain, global warning, and toxins in the air (Union of Concerned Scientists). In an average year, a single, typical coal plant generates 3.7 million tons of carbon dioxide ($CO_2$), 10,000 tons of sulfur dioxide ($SO_2$), 10,200 tons of nitric oxide ($NO_x$), 720 tons of carbon monoxide (CO), 220 tons of volatile organic compounds, 225 pounds of arsenic and many other toxic metals, including mercury.

Emissions of $NO_x$ include nitric oxide (NO) and nitrogen dioxide ($NO_2$). Free radicals of nitrogen ($N_2$) and oxygen ($O_2$) combine chemically primarily to form NO at high combustion temperatures. This thermal $NO_x$ tends to form even when nitrogen is removed from the fuel. Combustion modifications, which decrease the formation of thermal $NO_x$, generally are limited by the generation of objectionable byproducts.

Mobile and stationary combustion equipment are concentrated sources of $NO_x$ emissions. When discharged to the air, emissions of NO oxidize to form $NO_2$, which tends to accumulate excessively in many urban atmospheres. In sunlight, the $NO_2$ reacts with volatile organic compounds to form ground level ozone, eye irritants and photochemical smog. These adverse effects have prompted extensive efforts for controlling $NO_x$ emissions to low levels. Despite advancements in fuel and combustion technology, ground level ozone concentrations still exceed federal guidelines in many urban regions. Under the Clean Air Act and its amendments, these ozone nonattainment areas must implement stringent $NO_x$ emissions regulations. Such regulations will require low $NO_x$ emissions levels that are attained only by exhaust after treatment.

Exhaust-after-treatment techniques tend to reduce $NO_x$ using various chemical or catalytic methods. Such methods are known in the art and involve selective catalytic reduction (SCR) or selective noncatalytic reduction (SNCR). Such after-treatment methods typically require some type of reactant such as ammonia or other nitrogenous agent for removal of $NO_x$ emissions.

SCR is performed typically between the boiler and air (pre) heater and, though effective in removing nitrogen oxides, represents a major retrofit for coal-fired power plants. SCR commonly requires a large catalytic surface and capital expenditure for ductwork, catalyst housing, and controls. Expensive catalysts must be periodically replaced, adding to ongoing operational costs.

Combustion exhaust containing excess $O_2$ generally requires chemical reductant(s) for $NO_x$ removal. Commercial SCR systems primarily use ammonia ($NH_3$) or urea ($CH_4N_2O$) as the reductant. Chemical reactions on a solid catalyst surface convert $NO_x$ to $N_2$. These solid catalysts are selective for $NO_x$ removal and do not reduce emissions of CO and unburned hydrocarbons. Excess $NH_3$ needed to achieve low NO levels tends to result in $NH_3$ breakthrough as a byproduct emission.

Large catalyst volumes are normally needed to maintain low levels of $NO_x$ and inhibit $NH_3$ breakthrough. The catalyst activity depends on temperature and declines with use. Normal variations in catalyst activity are accommodated only by enlarging the volume of catalyst or limiting the range of combustion operation. Catalysts may require replacement prematurely due to sintering or poisoning when exposed to high levels of temperature or exhaust contaminants. Even under normal operating conditions, the SCR method requires a uniform distribution of $NH_3$ relative to $NO_x$ in the exhaust gas. $NO_x$ emissions, however, are frequently distributed non-uniformly, so low levels of both $NO_x$ and $NH_3$ breakthrough may be achieved only by controlling the distribution of injected $NH_3$ or mixing the exhaust to a uniform $NO_x$ level.

SCR catalysts can have other catalytic effects that can undesirably alter flue gas chemistry for mercury capture. Sulfur dioxide ($SO_2$ can be catalytically oxidized to sulfur trioxide, $SO_3$ which is undesirable because it can cause problems with the operation of the boiler or the operation of air pollution control technologies, including the following: interferes with mercury capture on fly ash or with activated carbon sorbents downstream of the SCR; reacts with excess ammonia in the air preheater to form solid deposits that interfere with flue gas flow; forms an ultrafine sulfuric acid aerosol, which is emitted out the stack.

Although SCR is capable of meeting regulatory $NO_x$ reduction limits, additional $NO_x$ removal prior to the SCR is desirable to reduce the amount of reagent ammonia introduced within the SCR, extend catalyst life and potentially reduce the catalyst surface area and activity required to achieve the final $NO_x$ control level. For systems without SCR installed, a $NO_x$ trim technology, such as SNCR, combined with retrofit combustion controls, such as low $NO_x$ burners and staged combustion, can be combined to achieve regulatory compliance.

SNCR is a retrofit $NO_x$ control technology in which ammonia or urea is injected post-combustion in a narrow temperature range of the flue path. SNCR can optimally remove up to 20 to 40% of $NO_R$. It is normally applied as a $NO_x$ trim method, often in combination with other $NO_x$ control methods. It can be difficult to optimize for all combustion conditions and plant load. The success of SNCR for any plant is highly dependent on the degree of mixing and distribution that is possible in a limited temperature zone. Additionally, there can be maintenance problems with SNCR systems due to injection lance pluggage and failure.

Other techniques have been employed to control $NO_x$ emissions. Boiler design and burner configuration, for example, can have a major influence on $NO_x$ emission levels. Physically larger furnaces (for a given energy input) can have low furnace heat release rates which lead to decreased levels of $NO_x$. The use of air-staged burners and over-fire air, both of which discourage the oxidation of nitrogen by the existence of sub-stoichiometric conditions in the primary combustion zone, can also lead to lower levels of $NO_x$. Over-fire air employs the same strategy as air-staging in which the oxidation of nitrogen is discouraged by the existence of sub-stoichiometric conditions in the primary combustion zone.

Another major contaminant of coal combustion is mercury. Mercury enters the furnace associated with the coal, it is volatilized upon combustion. Once volatilized, mercury tends not to stay with the ash, but rather becomes a component of the flue gases. If remediation is not undertaken, the mercury tends to escape from the coal burning facility, leading to severe environmental problems. Some mercury today is captured by pollution control machinery, for example in wet scrubbers and particulate control devices such as electrostatic precipitators and baghouses. However, most mercury is not captured and is therefore released through the exhaust stack.

In addition to wet scrubbers and particulate control devices that tend to remove mercury partially from the flue gases of coal combustion, other methods of control have included the use of activated carbon systems. Use of such systems tends to be associated with high treatment costs and elevated capital costs. Further, the use of activated carbon systems leads to carbon contamination of the fly ash collected in exhaust air treatments such as the bag house and electrostatic precipitators.

There is a need for an additive and treatment process to reduce emissions of target contaminants, such as nitrogen oxides and mercury.

SUMMARY

These and other needs are addressed by the various aspects, embodiments, and configurations of the present disclosure. The present disclosure is directed generally to the removal of selected gas phase contaminants.

In a first embodiment, a method is provided that includes the steps:

(a) contacting a combustion feed material with an additive to form a combined combustion feed material, the additive comprising a nitrogenous material; and (b) combusting the combined combustion feed material to form an off-gas comprising a nitrogen oxide and a derivative of the nitrogenous material, the derivative of the nitrogenous material causing removal of the nitrogen oxide.

In another embodiment, a flue gas additive is provided that includes:

(a) a nitrogenous material that forms ammonia when combusted; and (b) a halogen-containing material that forms a gas phase halogen when combusted.

In another embodiment, a method is provided that includes the steps:

(a) combusting a combustion feed material in a combustion zone of a combustor, thereby generating a nitrogen oxide; and (b) introducing a nitrogenous material into the combustion zone to reduce the nitrogen oxide.

The combustion zone has a temperature commonly ranging from about 1,400° F. to about 3,500° F., more commonly from about 1,450° F. to about 2,000° F., and even more commonly from about 1,550° F. to about 1,800° F.

In yet another embodiment, a combined combustion feed material is provided that includes a nitrogenous material for reducing nitrogen oxides and coal.

The nitrogenous material is commonly one or both of an amine and amide, which thermally decomposes into ammonia. More commonly, the nitrogenous material is urea. While not wishing to be bound by any theory, the mechanism is believed to primarily be urea decomposition to ammonia followed by free radical conversion of $NH_3$ to $NH_2$* and then reduction of NO.

The additive can have a number of forms. In one formulation, the additive is a free flowing particulate composition having a $P_{80}$ size ranging from about 6 to about 20 mesh (Tyler). In another formulation, the primary particle size is controlled by an on-line milling method having a $P_{80}$ outlet size typically less than 60 mesh (Tyler). In another formulation, the nitrogenous material is supported by a particulate substrate, the particulate substrate being one or more of the combustion feed material, a zeolite, other porous metal silicate material, clay, activated carbon, char, graphite, (fly) ash, metal, and metal oxide. In yet another formulation, the nitrogenous material comprises a polymerized methylene urea.

When the combustion feed material includes mercury, which is volatilized by combustion of the combined combustion feed material, the additive can include a halogen-containing material to oxidize the elemental mercury.

In one application, an amount of nitrogenous material is added to the off-gas at a normalized stoichiometric ratio (NSR) of ammonia to nitrogen oxides of about 1 to 3. Commonly, the combined combustion feed material includes from about 0.05 to about 1 wt. % and even more commonly from about 0.05 to about 0.75 wt. % nitrogenous additive, and commonly a mass ratio of the nitrogen content of the nitrogenous material:halogen in the additive ranges from about 1:1 to about 2400:1.

When the nitrogenous material is added to the combustion feed material, loss of some of the nitrogenous material during combustion can occur. Commonly, at least a portion of the nitrogenous material in the combined combustion feed material is lost as a result of feed material combustion.

In an application, the additive is combined with the combustion feed material remote from the combustor and transported to the combustor.

In another application, process control is effected by the following steps/operations:

(a) monitoring at least one of the following parameters: rate of introduction of the additive to the combustor, concentration of gas phase molecular oxygen, combustor temperature, gas phase carbon monoxide, gas phase nitrogen dioxide concentration, gas phase nitric oxide concentration, gas phase $NO_x$, limestone concentration, and gas phase $SO_2$ concentration; and (b) when a selected change in the at least one of the parameters occurs, changing at least one of the parameters.

In one application, a mass ratio of the nitrogen:halogen in the additive ranges from about 1:1 to about 2400:1.

The additive closely resembles SNCR in that it can use the same reagents to reduce nitrogen oxides but it does not depend on a specific post-combustion injection location and does not utilize an injection grid. Distribution of the additive is not as critical as for SNCR because the reagent is added with the fuel and is pre-mixed during combustion.

The present disclosure can provide a number of advantages depending on the particular configuration. The present disclosure can allow comparable $NO_x$ reduction to SNCR while eliminating problems of reagent distribution, injection lance fouling and maintenance. It can also have a wider tolerance for process temperature variation than post-combustion SNCR since the nitrogenous reagent is introduced pre-combustion. The disclosure discloses processes for the application of typical nitrogen oxide reduction reagents but generally relies on boiler conditions to facilitate distribution and encourage appropriate reaction kinetics. Furthermore, the current process can use existing coal feed equipment as the motive equipment for introduction of the reagents to the boiler. Only minor process-specific equipment may be required. Use of the disclosed methods will decrease the amount of pollutants produced from a fuel, while increasing the value of such fuel. Because the additive can facilitate the removal of multiple contaminants, the additive can be highly versatile and cost effective. Finally, because the additive can use nitrogenous compositions which are readily available in certain areas, for example, the use of animal waste and the like, without the need of additional processing, the cost for the compositions may be low and easily be absorbed by the user.

These and other advantages will be apparent from the disclosure of the aspects, embodiments, and configurations contained herein.

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$—$X_n$, $Y_1$—$Y_m$, and $Z_1$—$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

"Absorption" is the incorporation of a substance in one state into another of a different state (e.g. liquids being absorbed by a solid or gases being absorbed by a liquid). Absorption is a physical or chemical phenomenon or a process in which atoms, molecules, or ions enter some bulk phase—gas, liquid or solid material. This is a different process from adsorption, since molecules undergoing absorption are taken up by the volume, not by the surface (as in the case for adsorption).

"Adsorption" is the adhesion of atoms, ions, biomolecules, or molecules of gas, liquid, or dissolved solids to a surface. This process creates a film of the adsorbate (the molecules or atoms being accumulated) on the surface of the adsorbent. It differs from absorption, in which a fluid permeates or is dissolved by a liquid or solid. Similar to surface tension, adsorption is generally a consequence of surface energy. The exact nature of the bonding depends on the details of the species involved, but the adsorption process is generally classified as physisorption (characteristic of weak van der Waals forces)) or chemisorption (characteristic of covalent bonding). It may also occur due to electrostatic attraction.

"Amide" refers to compounds with the functional group $R_nE(O)_xNR'_2$ (R and R' refer to H or organic groups). Most common are "organic amides" (n=1, E=C, x=1), but many other important types of amides are known including phosphor amides (n=2, E=P, x=1 and many related formulas) and sulfonamides (E=S, x=2). The term amide can refer both to classes of compounds and to the functional group ($R_nE(O)_n NR'_2$) within those compounds.

"Amines" are organic compounds and functional groups that contain a basic nitrogen atom with a lone pair. Amines are derivatives of ammonia, wherein one or more hydrogen atoms have been replaced by a substituent such as an alkyl or aryl group.

"Ash" refers to the residue remaining after complete combustion of the coal particles. Ash typically includes mineral matter (silica, alumina, iron oxide, etc.).

Circulating Fluidized Bed ("CFB") refers to a combustion system for solid fuel (including coal or biomass). In fluidized bed combustion, solid fuels are suspended in a dense bed using upward-blowing jets of air. Combustion takes place in the bed of suspended fuel particles. Large particles remain in the bed due to the balance between gravity and the upward convection of gas. Small particles are carried out of the bed. In a circulating fluidized bed, some particles of an intermediate size range are separated from the gases exiting the bed by means of a cyclone or other mechanical collector. These collected solids are returned to the bed. Limestone and/or sand is commonly added to the bed to provide a medium for heat and mass transfer. Limestone also reacts with $SO_2$ formed from combustion of the fuel to form $CaSO_4$.

"Coal" refers to a combustible material formed from prehistoric plant life. Coal includes, without limitation, peat, lignite, sub-bituminous coal, bituminous coal, steam coal, anthracite, and graphite. Chemically, coal is a macromolecular network comprised of groups of polynuclear aromatic rings, to which are attached subordinate rings connected by oxygen, sulfur, and aliphatic bridges.

Continuous Emission Monitor ("CEM") refers to an instrument for continuously analyzing and recording the concentration of a constituent in the flue gas of a combustion system; examples of constituents typically measured by CEMs are $O_2$, CO, $CO_2$, $NO_x$, $SO_2$ and Hg.

"Halogen" refers to an electronegative element of group VIIA of the periodic table (e.g., fluorine, chlorine, bromine, iodine, astatine, listed in order of their activity with fluorine being the most active of all chemical elements).

"Halide" refers to a chemical compound of a halogen with a more electropositive element or group.

"High alkali coals" refer to coals having a total alkali (e.g., calcium) content of at least about 20 wt. % (dry basis of the ash), typically expressed as CaO, while "low alkali coals" refer to coals having a total alkali content of less than 20 wt. % and more typically less than about 15 wt. % alkali (dry basis of the ash), typically expressed as CaO.

"High iron coals" refer to coals having a total iron content of at least about 10 wt. % (dry basis of the ash), typically expressed as $Fe_2O_3$, while "low iron coals" refer to coals having a total iron content of less than about 10 wt. % (dry basis of the ash), typically expressed as $Fe_2O_3$. As will be appreciated, iron and sulfur are typically present in coal in the form of ferrous or ferric carbonates and/or sulfides, such as iron pyrite.

"High sulfur coals" refer to coals having a total sulfur content of at least about 1.5 wt. % (dry basis of the coal) while "medium sulfur coals" refer to coals having between about 1.5 and 3 wt. % (dry basis of the coal) and "low sulfur coals" refer to coals having a total sulfur content of less than about 1.5 wt. % (dry basis of the coal).

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

Micrograms per cubic meter ("$\mu g/m^3$") refers to a means for quantifying the concentration of a substance in a gas and is the mass of the substance measured in micrograms found in a cubic meter of the gas.

Neutron Activation Analysis ("NAA") refers to a method for determining the elemental content of samples by irradiating the sample with neutrons, which create radioactive forms of the elements in the sample. Quantitative determination is achieved by observing the gamma rays emitted from these isotopes.

The term "nitrogen oxide" refers to one or more of nitric oxide (NO) and nitrogen dioxide ($NO_2$). Nitric oxide is commonly formed at higher temperatures and becomes nitrogen dioxide at lower temperatures.

The term normalized stoichiometric ratio ("NSR"), when used in the context of $NO_x$ control, refers to the ratio of the moles of nitrogen contained in a compound that is injected into the combustion gas for the purpose of reducing $NO_x$ emissions to the moles of $NO_x$ in the combustion gas in the uncontrolled state.

"Particulate" refers to free flowing particles, such as finely sized particles, fly ash, unburned carbon, soot and fine process solids, which may be entrained in a gas stream.

Pulverized coal ("PC") boiler refers to a coal combustion system in which fine coal, typically with a median diameter of 100 microns, is mixed with air and blown into a combustion chamber. Additional air is added to the combustion chamber such that there is an excess of oxygen after the combustion process has been completed.

The phrase "ppmw X" refers to the parts-per-million, based on weight, of X alone. It does not include other substances bonded to X.

The phrase "ppmv X" refers to the parts-per-million, based on volume in a gas, of X alone. It does not include other substances bonded to X.

"Separating" and cognates thereof refer to setting apart, keeping apart, sorting, removing from a mixture or combination, or isolating. In the context of gas mixtures, separating can be done by many techniques, including electrostatic precipitators, baghouses, scrubbers, and heat exchange surfaces.

A "sorbent" is a material that sorbs another substance; that is, the material has the capacity or tendency to take it up by sorption.

"Sorb" and cognates thereof mean to take up a liquid or a gas by sorption.

"Sorption" and cognates thereof refer to adsorption and absorption, while desorption is the reverse of adsorption.

"Urea" or "carbamide" is an organic compound with the chemical formula $CO(NH_2)_2$. The molecule has two —$NH_2$ groups joined by a carbonyl (C═O) functional group.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

The Additive

Figure 1:
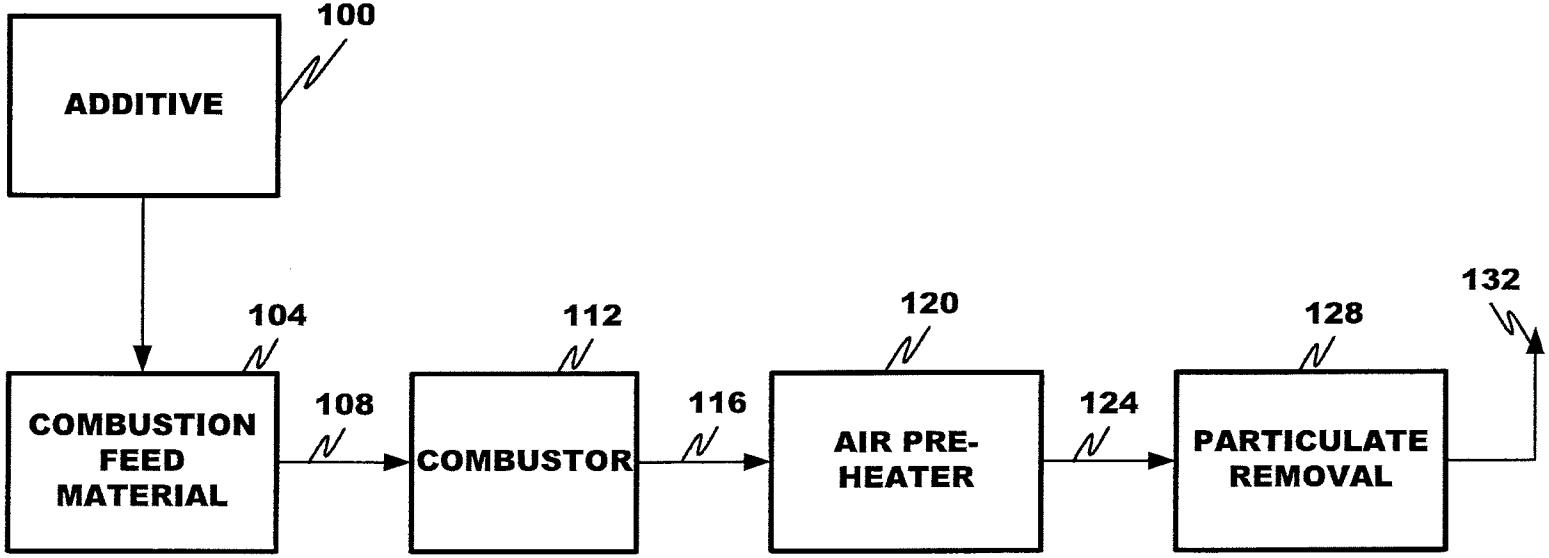
FIG. 1 is a block diagram according to an embodiment showing a common power plant configuration.

The additive comprises at least two components, one to cause removal of nitrogen oxides and the other to cause removal of elemental mercury. The former component uses a nitrogenous material, commonly an ammonia precursor such as an amine and/or amide, while the latter uses a halogen or halogen-containing material.

The additive can contain a single substance for reducing pollutants, or it can contain a mixture of such substances. For example, the additive can contain a a single substance including both an amine or amide and a halogen, such as a haloamine formed by at least one halogen and at least one amine, a halamide formed by at least one halogen and at least one amide, or other organohalide including both an ammonia precursor and dissociable halogen. In an embodiment, the additive comprises an amine or amide. In an embodiment, the precursor composition comprises a halogen. In a preferred embodiment, the precursor composition contains a mixture of an amine and/or an amide, and a halogen.

The Nitrogenous Component

Without being bound by theory, the ammonia precursor is, under the conditions in the furnace or boiler, thermally decomposed to form ammonia gas, or possibly free radicals of ammonia ($NH_3$) and amines ($NH_2$) (herein referred to collectively as "ammonia"). The resulting ammonia reacts with nitrogen oxides formed during the combustion of fuel to yield gaseous nitrogen and water vapor according to the following global reaction:

$$2NO+2NH_3+\tfrac{1}{2}O_2 \rightarrow 2N_2+3H_2O \quad (1)$$

The optimal temperature range for Reaction (1) is from about 1550° F. to 2000° F. Above 2000° F., the nitrogenous compounds from the ammonia precursor may be oxidized to form $NO_x$. Below 1550° F., the production of free radicals of ammonia and amines may be too slow for the global reaction to go to completion.

Commonly, the ammonia precursor is an amine or amide. Sources of amines or amides include any substance that, when heated, produces ammonia gas and/or free radicals of ammonia. Examples of such substances include, for example, urea, carbamide, polymeric methylene urea, animal waste, ammonia, methamine urea, cyanuric acid, and combinations and mixtures thereof. In an embodiment, the substance is urea. In an embodiment, the substance is animal waste.

Commonly at least about 25%, more commonly at least most, more commonly at least about 75%, more commonly at least about 85% and even more commonly at least about 95% of the nitrogenous component is added in liquid or solid form to the combustion feed material. Surprisingly and unexpectedly, it has been discovered that co-combustion of the nitrogenous component with the combustion feed material does not thermally decompose the nitrogenous component to a form that is unable to react with nitrogen oxides or to nitrogen oxides themselves. Compared to post-combustion addition of the nitrogenous component, co-combustion has the advantage of not requiring an injection grid or specific post-combustion injection location in an attempt to provide adequate mixing of the additive with the combustion off-gas, or flue gas. Distribution of the nitrogenous component is not as critical as for post-combustion addition of the component because the additive is added with the combustion feed material and is pre-mixed, and substantially homogeneously distributed, during combustion. Additionally, the nitrogenous component can advantageously be added to the combustion feed material at a remote location, such as prior to shipping to the utility plant or facility.

The nitrogenous component can be formulated to withstand more effectively, compared to other forms of the nitrogenous component, the thermal effects of combustion. In one formulation, at least most of the nitrogenous component is added to the combustion feed material as a liquid, which is able to absorb into the matrix of the combustion feed material. The nitrogenous component will volatilize while the bulk of the combustion feed material consumes a large fraction thermal energy that could otherwise thermally degrade the nitrogenous component. The nitrogenous component can be slurried or dissolved in the liquid formulation. The liquid formulation can include other components, such as a solvent (e.g., water, surfactants, buffering agents and the like), and a binder to adhere or bind the nitrogenous component to the combustion feed material, such as a wax or wax derivative, gum or gum derivative, and other inorganic and organic binders designed to disintegrate thermally during combustion (before substantial degradation of the nitrogenous component occurs), thereby releasing the nitrogenous component into the boiler or furnace freeboard, or into the off-gas. A typical nitrogenous component concentration in the liquid formulation ranges from about 20% to about 60%, more typically from about 35% to about 55%, and even more typically from about 45% to about 50%. In another formulation, at least most of the nitrogenous component is added to the combustion feed material as a particulate. In this formulation, the particle size distribution ($P_{80}$ size) of the nitrogenous component particles as added to the fuel commonly ranges from about 20 to about 6 mesh (Tyler), more commonly from about 14 to about 8 mesh (Tyler), and even more commonly from about 10 to about 8 mesh (Tyler).

Figure 7:
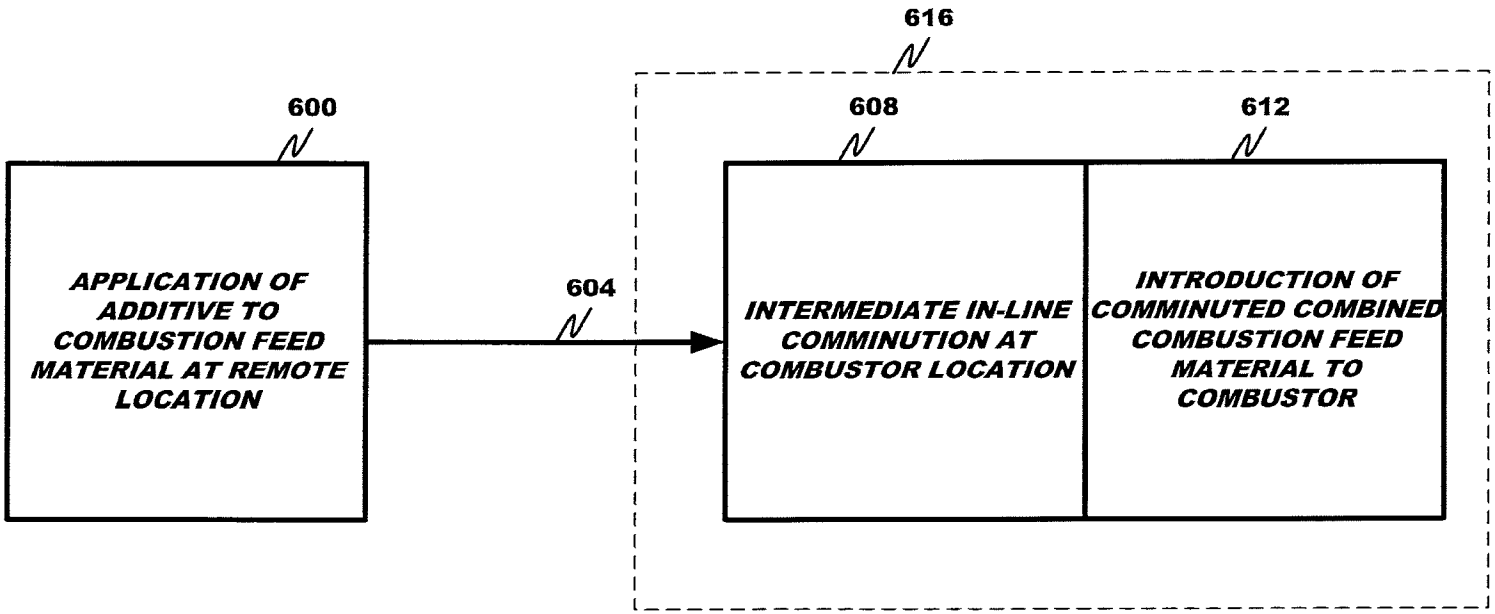
FIG. 7 is a block diagram showing transportation of the combined combustion feed material to the combustor from a remote location according to an embodiment.

With reference to FIG. 7, the combined combustion feed material 108 containing solid nitrogenous particulates are added at a remote location 600, such as a mine site, transported or shipped 604, such as by rail or truck, to the plant site 616, where it is stockpiled in intermediate storage. The combined combustion feed material 108 is removed from storage, comminuted in 608 in-line comminution device to de-agglomerate the particulates in the combined combustion feed material 108, and then introduced 612 to the combustor 112 in the absence of further storage or stockpiling. Such comminution may be accomplished by any of a number of commercial size reduction technologies including but not limited to a crusher or grinder.

In another configuration, the additive particulates are stockpiled at the plant site 616 and further reduced in size from a first size distribution to a more finely sized second size distribution by an in-line intermediate milling stage 608 between storage and addition to the coal feed, which combined combustion feed material 108 is then introduced 612 to the combustor 112 without further storage. In one application, a $P_{80}$ particle size distribution of the additive is reduced from about 6 to 20 mesh (Tyler) to no more than about 200 mesh (Tyler) via in-line milling followed by introduction, without intermediate storage, to the combustor. Typically, a time following in-line milling to introduction to the combustor 112 is no more than about 5 days, more typically no more than about 24 hours, more typically no more than about 1 hour, more typically no more than about 0.5 hours, and even more typically no more than about 0.1 hours. This stage may reduce the particle residence time in the combustion zone. Such milling may be accomplished by any of a number of commercial size reduction technologies including but not limited to jet mill, roller mill and pin mill. Milling of nitrogenous materials is a continuous in-line process since the materials are prone to re-agglomeration. At least a portion of the nitrogenous component will sublime or otherwise vaporize to the gas phase without thermally decomposing. In this formulation, the particle size distribution ($P_{80}$ size) of the nitrogenous component particles as added to the combustion feed material 104 commonly ranges from about 400 to about 20 mesh (Tyler), more commonly from about 325 to about 50 mesh (Tyler), and even more commonly from about 270 to about 200 Mesh (Tyler).

In another formulation, the nitrogenous component is combined with other chemicals to improve handing characteristics and/or support the desired reactions and/or inhibit thermal decomposition of the nitrogenous component. For example, the nitrogenous component, particularly solid amines or amides, whether supported or unsupported, may be encapsulated with a coating to alter flow properties or provide some protection to the materials against thermal decomposition in the combustion zone. Examples of such coatings include silanes, siloxanes, organosilanes, amorphous silica or clays. In yet another formulation, granular long chain polymerized methylene ureas are preferred reagents, as the kinetics of thermal decomposition are expected to be relatively slower and therefore a larger fraction of unreacted material may still be available past the flame zone. Other granular urea products with binder may also be employed. In yet another formulation, the nitrogenous component is supported by a substrate other than a combustion feed material. Exemplary substrates to support the nitrogenous component include zeolites (or other porous metal silicate materials), clays, activated carbon (e.g., powdered, granular, extruded, bead, impregnated, and/or polymer coated activated carbon), char, graphite, (fly) ash, (bottom) ash, metals, metal oxides, and the like. In any of the above formulations, other thermally adsorbing materials may be applied to substantially inhibit or decrease the amount of nitrogenous component that degrades thermally during combustion. Such thermally adsorbing materials include, for example, amines and/or amides other than urea (e.g., monomethylamine and alternative reagent liquids).

The Halogen Component

Compositions comprising a halogen compound contain one or more organic or inorganic compounds containing a halogen or a combination of halogens, including but not limited to chlorine, bromine, and iodine. Preferred halogens are bromine and iodine. The halogen compounds noted above are sources of the halogens, especially of bromine and iodine. For bromine, sources of the halogen include various inorganic salts of bromine including bromides, bromates, and hypobromites. In various embodiments, organic bromine compounds are less preferred because of their cost or availability. However, organic sources of bromine containing a suitably high level of bromine are considered within the scope of the invention. Non-limiting examples of organic bromine compounds include methylene bromide, ethyl bromide, bromoform, and carbonate tetrabromide. Non-limiting sources of iodine include hypoiodites, iodates, and iodides, with iodides being preferred. Furthermore, because various compositions of combustion feed materials may be combined and used, combustion feed materials rich in native halogens may be used as the halogen source.

When the halogen compound is an inorganic substituent, it can be a bromine- or iodine-containing salt of an alkali metal or an alkaline earth element. Preferred alkali metals include lithium, sodium, and potassium, while preferred alkaline earth elements include magnesium and calcium. Halide compounds, particularly preferred are bromides and iodides of alkaline earth metals such as calcium.

There are a number of possible mechanisms for mercury capture in the presence of a halogen.

Without being bound by theory, the halogen reduces mercury emissions by promoting mercury oxidation, thereby causing it to better adsorb onto the fly ash or absorb in scrubber systems. Any halogen capable of reducing the amount of mercury emitted can be used. Examples of halogens useful for practicing the present invention include fluorine, chlorine, bromine, iodine, or any combination of halogens.

While not wishing to be bound by any theory, oxidation reactions may be homogeneous, heterogeneous, or a combination thereof. A path for homogeneous oxidation of mercury appears to be initiated by one or more reactions of elemental mercury. and free radicals such as atomic Br and atomic I. For heterogeneous reactions, a diatomic halogen molecule, such as $Br_2$ or $I_2$, or a halide, such as HBr or HI, reacts with elemental mercury on a surface. The reaction or collection surface can, for example, be an air preheater surface, duct internal surface, an electrostatic precipitator plate, an alkaline spray droplet, dry alkali sorbent particles, a baghouse filter, an entrained particle, fly ash, carbon particle, or other available surface. It is believed that the halogen can oxidize typically at least most, even more typically at least about 75%, and even more typically at least about 90% of the elemental mercury in the flue gas stream.

Under most flue gas conditions, the mercury reaction kinetics for iodine appear to be faster at higher temperatures than mercury reaction kinetics for chlorine or bromine at the same temperature. With chlorine, almost all the chlorine in the flame is found as HCl, with very little Cl. With bromine, there are, at high temperatures, approximately equal amounts of HBr on the one hand and $Br_2$ on the other. This is believed to be why oxidation of Hg by bromine is more efficient than oxidation by chlorine. Chemical modeling of equilibrium iodine speciation in a subbituminous flue gas indicates that, at high temperatures, there can be one thousand times less HI than 1 (in the form of atomic iodine) in the gas. At lower temperatures, typically below 800° F., diatomic halogen species, such as $I_2$, are predicted to be the major iodine-containing species in the gas. In many applications, the molecular ratio, in the gas phase of a mercury-containing gas stream, of diatomic iodine to hydrogen-iodine species (such as HI) is typically at least about 10:1, even more typically at least about 25:1, even more typically at least about 100:1, and even more typically at least about 250:1.

While not wishing to be bound by any theory, the end product of reaction can be mercuric iodide ($HgI_2$ or $Hg_2I_2$), which has a higher condensation temperature (and boiling point) than both mercuric bromide ($HgBr_2$ or $Hg_2Br_2$) and mercuric chloride ($HgCl_2$ or $Hg_2Cl_2$). The condensation temperature (or boiling point) of mercuric iodide (depending on the form) is in the range from about 353 to about 357° C. compared to about 322° C. for mercuric bromide and about 304° C. for mercuric chloride. The condensation temperature (or boiling point) for iodine ($I_2$) is about 184° C. while that for bromine ($Br_2$) is about 58° C.

While not wishing to be bound by any theory, another possible reaction path is that other mercury compounds are formed by multi-step reactions with the halogen as an intermediate.

As will be appreciated, any of the above theories may not prove to be correct. As further experimental work is performed, the theories may be refined and/or other theories developed. Accordingly, these theories are not to be read as limiting the scope or breadth of this disclosure.

Flue Gas Treatment Process Using the Additive

Referring to FIG. 1, an implementation of the additive 100 is depicted.

The combustion feed material 104 can be any carbonaceous and combustion feed material, with coal being common. The coal can be a high iron, alkali and/or sulfur coal. Coal useful for the process can be any type of coal including, for example, anthracite coal, bituminous coal, subbituminous coal, low rank coal or lignite coal. Furthermore, the composition of components in coal may vary depending upon the location where the coal was mined. The process may use coal from any location around the world, and different coals from around the world may be combined without deviating from the present invention.

The additive 100 is added to the combustion feed material 104 to form a combined combustion feed material 108. The amount of additive 100 added to the combustion feed material 104 and the relative amounts of the nitrogenous and halogen-containing components depend on the amount of nitrogen oxides and elemental mercury, respectively, generated by the combustion feed material 104 when combusted. In the former case, commonly at least about 50%, more commonly at least about 100%, and even more commonly at least about 300% of the theoretical stoichiometric ratio of the nitrogenous component required to remove the nitrogen oxides in the off-gas is added to the combustion feed material 104. In many applications, the amount of $NO_X$ produced by combustion of a selected combustion feed material 104 in the absence of addition of the nitrogenous component is reduced commonly by an amount ranging from about 10 to about 50% and more commonly from about 20 to about 40% with nitrogenous component addition.

In absolute terms, the combined combustion feed material 108 comprises commonly from about 0.05 to about 0.5, more commonly from about 0.1 to about 0.4, and even more commonly from about 0.2 to about 0.4 wt. % additive, with the remainder being coal. The mass ratio of the nitrogen:halogen in the additive 100 commonly ranges from about 1:1 to about 2400:1, more commonly from about 7:1 to about 900:1, and even more commonly from about 100:1 to about 500:1.

The additive 100 is commonly added to the combustion feed material 104 prior to its combustion. Given that the combustion feed material 104 can be in any form, the additive 100 can also be in any form convenient for adding to a given combustion feed material 104. For example, the additive 100 can be a liquid, a solid, a slurry, an emulsion, a foam, or combination of any of these forms. The contact of the additive 100 and combustion feed material 104 can be effected by any suitable technique so long as the distribution of the additive 100 throughout the combustion feed material 104 is substantially uniform or homogenous. Methods of combining the additive 100 with the combustion feed material 104 will largely be determined by the combustion feed material 104 and the form of the additive 100. For example, if the combustion feed material 104 is coal and the additive 100 is in a solid form, they may be mixed together using any means for mixing solids (e.g., stirring, tumbling, crushing, etc.). If the combustion feed material 104 is coal and the additive 100 is a liquid or slurry, they may be mixed together using suitable means such as, for example, mixing, stirring or spraying.

The additive 100 may be added to the combustion feed material 104 at a time prior to the fuel being delivered to the combustor 112. Moreover, contact of the additive 100 and combustion feed material 104 can occur on- or off-site. In other words, the contact can occur at the mine where the combustion feed material 104 is extracted or at some point in between the mine and utility, such as an off-loading or load transfer point.

In one application and as discussed above in connection with FIG. 7, the additive 100 is added to the combustion feed material 104 at a physical location different than the location of, or off-site relative to, the combustor 112. By way of example, the additive 100 can be added to the combustion feed material 104 at the site of production of the combustion feed material 104 (e.g., the coal mine). Likewise, the additive 100 can be added to the combustion feed material 104 at a site secondary to the site of production, but that is not the site of combustion (e.g., a refinery, a storage facility). Such a secondary site can be a storage facility located on the property of a combustor 112, for example, a coal pile or hopper located near a combustor 112. In one particular application, the combustion feed material 104 is treated with the additive 100 at a site that is commonly at least about 1,000 miles, more commonly at least about 500 miles, more commonly at least about 10 miles, more commonly at least about 5 miles, and even more commonly at least about 0.25 mile away from the combustor 112.

In some embodiments, the additive 100 is added to the combustion feed material 104 and then shipped to another location or stored for a period of time. The amount of the additive 100 required to reduce the nitrogen oxide is dependent upon the form of the additive 100, whether it be liquid, solid or a slurry, the type of coal and its composition, as well as other factors including the kinetic rate and the type of combustion chamber. Typically the nitrogenous material is applied to the coal feed in a range of 0.05% to 0.75% by weight of the coal. The additive 100 can also comprise other substances that aid in delivery of the nitrogenous material to the combustion feed material 104. For example, the precursor composition may comprise a dispersant that more evenly distributes the additive 100.

The combined combustion feed material 108 is introduced into a combustor 112 where the combined combustion feed material 108 is combusted to produce an off-gas or flue gas 116. The combustor 112 can be any suitable thermal combustion device, such as a furnace, a boiler, a heater, a fluidized bed reactor, an incinerator, and the like. In general, such devices have some kind of feeding mechanism to deliver the fuel into a furnace where the fuel is burned or combusted. The feeding mechanism can be any device or apparatus suitable for use. Non-limiting examples include conveyer systems, hoppers, screw extrusion systems, and the like. In operation, the combustion feed material 104 is fed into the furnace at a rate suitable to achieve the output desired from the furnace.

The target contaminants, namely nitrogen oxides and mercury, volatilize or are formed in the combustor 112. While not wishing to be bound by any theory, nitrogen oxides form in response to release of nitrogen in the coal as ammonia, HCN, and tars. Oxidation of these compounds is believed to produce $NO_X$. Competition is believed to exist between oxidation of nitrogen and conversion to molecular nitrogen. Nitrogen is believed to be oxidized either heterogeneously (which is the dominant oxidation mechanism at off-gas temperatures less than about 1,470° F.) or homogeneously (which is the dominant oxidation mechanism at off-gas temperatures of more than about 1,470° F.). Heterogeneous solid surface catalytic oxidation of nitrogen on limestone is believed to yield NO. In homogeneous gas phase oxidation, ammonia is believed to be oxidized to molecular nitrogen, and HCN to nitrous oxide Gas phase species, such as $SO_2$* and halogen free radicals such as Br* and I*, are believed to increase the concentration of carbon monoxide while decreasing the concentration of NO. Under reducing conditions in the combustion zone, $SO_2$* is believed to be released, and some $CaSO_4$ is converted back to CaO. Reducing conditions normally exist in the bed even at overall fuel lean stoichiometric ratios. NO oxidation to $NO_2$ is believed to occur with gas phase hydrocarbons present and is not reduced back to NO under approximately 1,550° F.

Commonly, at least most of the nitrogen oxides or $NO_X$ are in the form of nitric oxide and, more commonly, from about 90-95% of the $NO_X$ is nitric oxide. The remainder is commonly in the form of nitrogen dioxide. At least a portion of the mercury is in elemental form, with the remainder being speciated. Commonly, target contaminant concentrations in the flue gas 116, in the absence of additive treatment ranges from about 50 to about 500 ppmv for nitrogen oxides and from about 1 to about 40 $\mu g/m^3$ for elemental mercury.

The combustor 112 can have a number of different designs.

Figure 2:
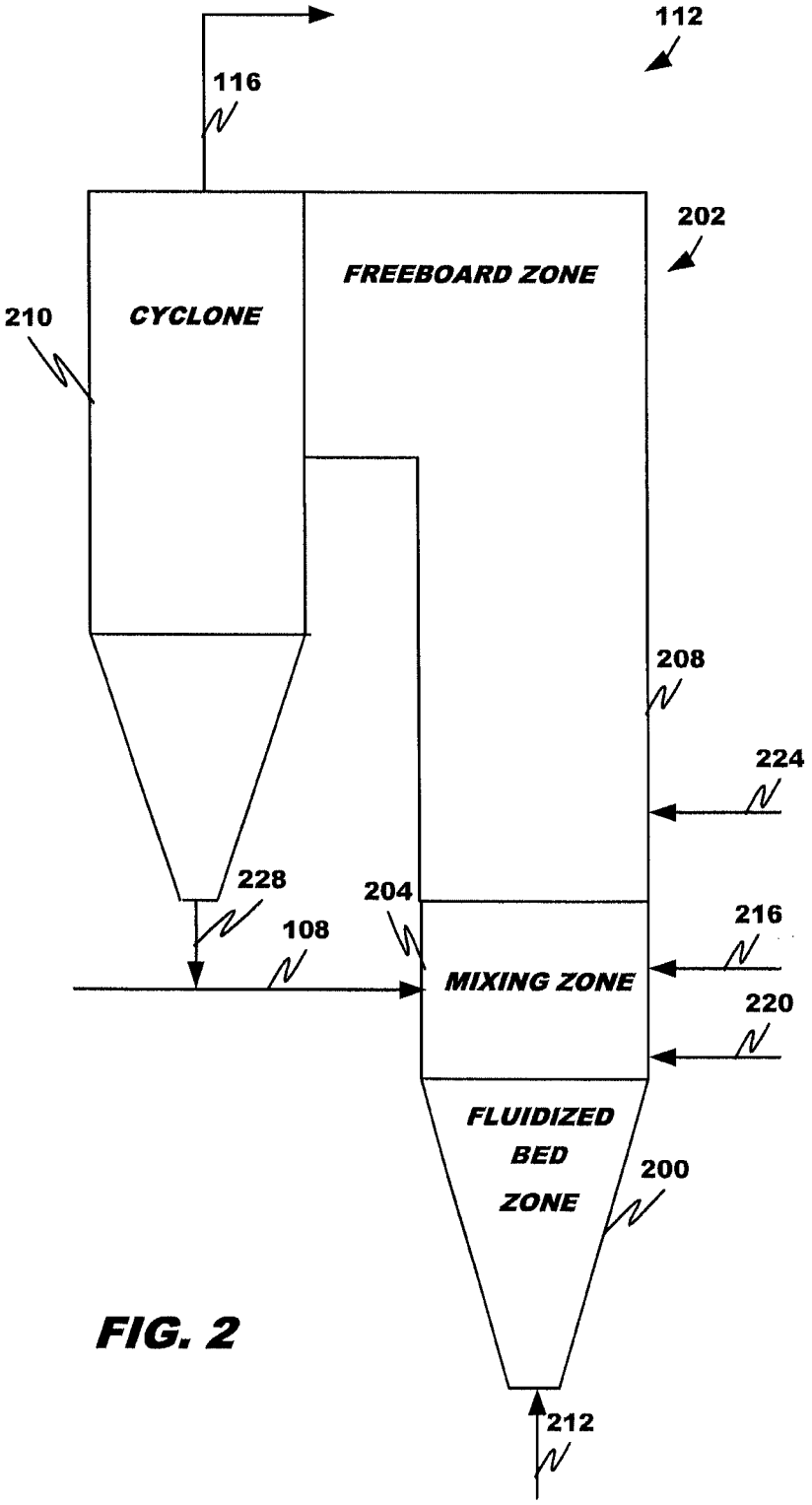
FIG. 2 is a block diagram of a CFB boiler-type combustor according to an embodiment.

FIG. 2 depicts a combustor 112 having a circulating fluidized bed ("CFB") boiler design. The combustor 112 includes a CFB boiler 202 having fluidized bed zone 200 (where larger particulates of coal and additive 100 collect after introduction into the combustor 112), mixing zone 204 (where the introduced combined combustion feed material 108 mixes with upwardly rising combustion off-gases), and freeboard zone 208 (where finely sized particulates of combined combustion feed material 108 and solid partial or complete combustion byproducts are entrained with the flow of the off-gases) combustor sections and a cyclone 210 in fluid communication with the boiler. Primary air 212 enters through the bottom of the boiler to fluidize the bed and form the fluidized bed zone 200. The bed contains not only the combined combustion feed material 108 but also limestone particulates 216, both introduced in the fluidized bed zone 200. The particle $P_{80}$ size distribution for the combustion feed material 104 and 108 particulates commonly ranges from about 325 to about 140 mesh (Tyler) and for the limestone particulates commonly ranges from about 140 to about 6 mesh (Tyler). Secondary air 220 is introduced above the fluidized bed zone 200 and into the freeboard zone 208. Overfire air 224 is introduced into the freeboard 208. The combined combustion feed material 108 further includes (partially combusted or uncombusted) finely sized solid particulates 228 recovered by the cyclone 210 from the off-gas received from the freeboard zone 208. The finely sized solid particulates are typically one or more of uncombusted or partially combusted feed material particulates and/or limestone particulates. Recycled particulates can have an adsorbed amine and/or amide and/or ammonia, which can be beneficial to $NO_X$ reduction. Limestone is used to control emissions of sulfur oxides or $SO_X$. In one configuration, the additive 100 is contacted with the finely sized solid particulates 228 before they are contacted with the combustion feed material 104. Prior to the contact, the combustion feed material 104 may or may not contain the additive. In one configuration, the additive 100 is contacted with the combustion feed material 104 before the combustion feed material 104 is contacted with the finely sized solid particulates 228.

The temperatures in the fluidized bed zone 200 (or combustion zone), and freeboard zone 208 sections varies depending on the CFB design and the combustion feed material. Temperatures are controlled in a range that is safely below that which the bed material could fuse to a solid. Typically, the fluidized bed zone 200 temperature is at least about 1,400° F., more typically at least about 1,500° F., and even more typically at least about 1,550° F. but typically no more than about 1,800° F., more typically no more than about 1,700° F., more typically no more than about 1,650° F., and even more typically no more than about 1,600° F. Typically, the freeboard zone 208 temperature is at least about 1,500° F., more typically at least about 1,550° F., and even more typically at least about 1,600° F. but typically no more than about 1,800° F., more typically no more than about 1,750° F., more typically no more than about 1,600° F., and even more typically no more than about 1,550° F.

The primary air 212 typically constitutes from about 30 to about 35% of the air introduced into the system; the secondary air 220 from about 50 to about 60% of the air introduced into the system; and the remainder of the air introduced into the combustor 112 is the overfire air 224.

In one configuration, additional additive is introduced in the freeboard zone 208, such as near the entrance to the cyclone 210 (where high gas velocities for turbulent mixing and significant residence time in the cyclone are provided). In other configurations, additional additive is introduced into the mixing zone 204 and/or fluidized bed zone 200.

Figure 3:
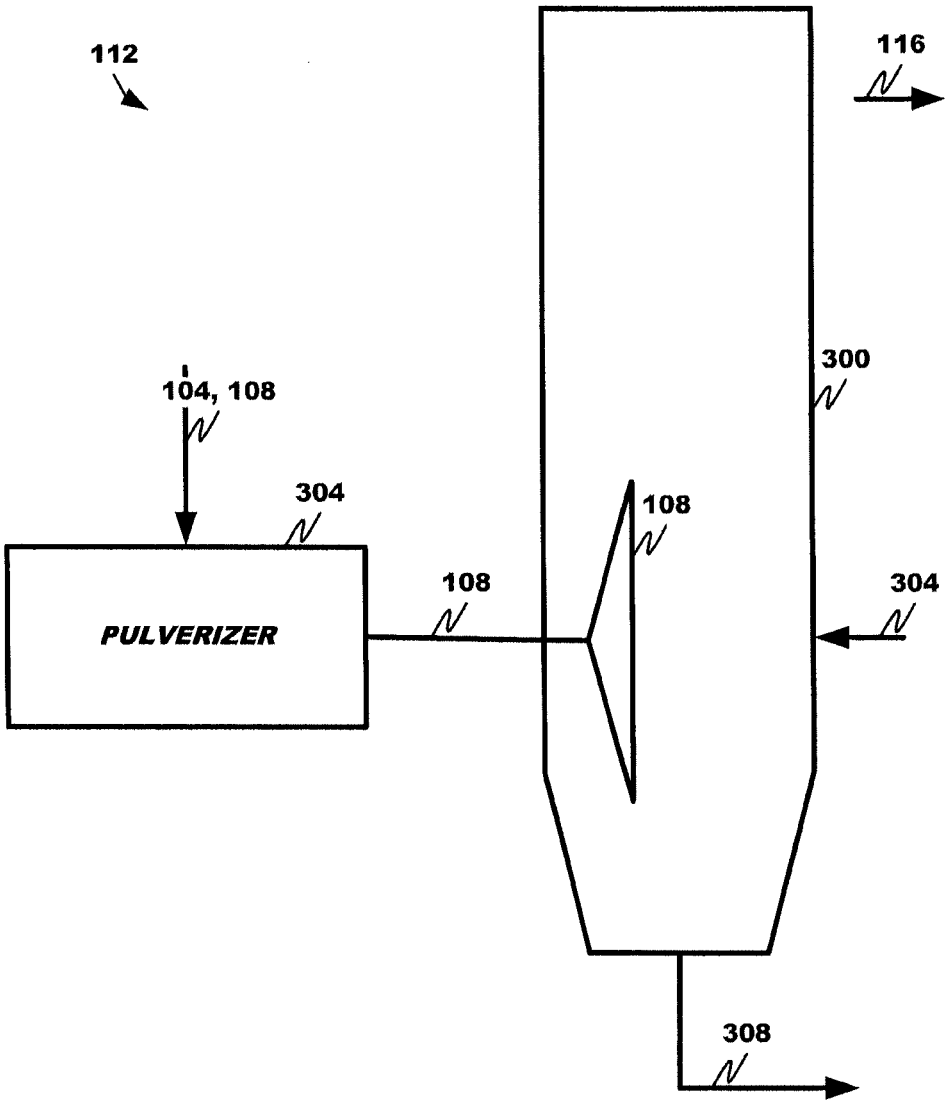
FIG. 3 is a block diagram of a PC boiler-type combustor according to an embodiment.

FIG. 3 depicts a combustor 112 having a pulverized coal boiler ("PC") design. The combustor 112 includes a PC boiler 300 in communication with a pulverizer 304. The combustion feed material 104 or 108 is comminuted in a pulverizer 304 and the comminuted combined combustion feed material 108 introduced, typically by injection, into the PC boiler 300 as shown. The particle $P_{80}$ size distribution for the comminuted combustion feed material 108 particulates commonly ranges from about 325 to about 60 mesh (Tyler). Primary combustion air 304 is introduced into the combustion zone of the PC boiler 300 in spatial proximity to the point of introduction of the pulverized combustion feed material 108. Combustion off-gas or flue gas 116 is removed from the upper portion of the PC boiler 300, and ash or slag 308, the byproduct of coal combustion, from the lower portion of the PC boiler 300. In one configuration, the additive 100 is contacted with the combustion feed material 104 before comminution by the pulverizer 304. In one configuration, the additive 100 is contacted with the combustion feed material 104 during comminution. In one configuration, the additive 100 is contacted with the combustion feed material 104 after comminution.

The temperature in the combustion zone varies depending on the PC boiler design and combustion feed material. Typically, the temperature is at least about 2,000° F., more typically at least about 2,250° F., and even more typically at least about 2,400° F. but no more than about 3,500° F., more commonly no more than about 3,250° F., and even more commonly no more than about 3,000° F.

In one configuration, additional additive is introduced in the upper portion of the PC boiler 300 near the outlet for the flue gas 116 (where high gas velocities for turbulent mixing and significant residence time are provided). In other configurations, additional additive is introduced into the combustion zone in the lower portion of the PC boiler 300.

Returning to FIG. 1, after the combustor 112 the facility provides convective pathways for the combustion off-gases, or flue gases, 116. Hot flue gases 116 and air move by convection away from the flame through the convective pathway in a downstream direction. The convection pathway of the facility contains a number of zones characterized by the temperature of the gases and combustion products in each zone. The combustion off-gases 116 upstream of the air pre-heater 120 (which preheats air before introduction into the combustor 112) is known as the "hot-side" and the combustion off-gases 124 downstream of the air pre-heater 120 as the "cold-side".

Generally, the temperature of the combustion off-gases 116 falls as they move in a direction downstream from the combustion zone in the combustor 112. The combustion off-gases 116 contain carbon dioxide as well as various undesirable gases containing sulfur, nitrogen, and mercury and entrained combusted or partially combusted particulates, such as fly ash. To remove the entrained particulates before emission into the atmosphere, particulate removal systems 128 are used. A variety of such removal systems can be disposed in the convective pathway, such as electrostatic precipitators and/or a bag house. In addition, dry or wet chemical scrubbers can be positioned in the convective pathway. At the particulate removal system 128, the off-gas 124 has a temperature of about 300° F. or less before the treated off-gases 132 are emitted up the stack.

Figure 4:
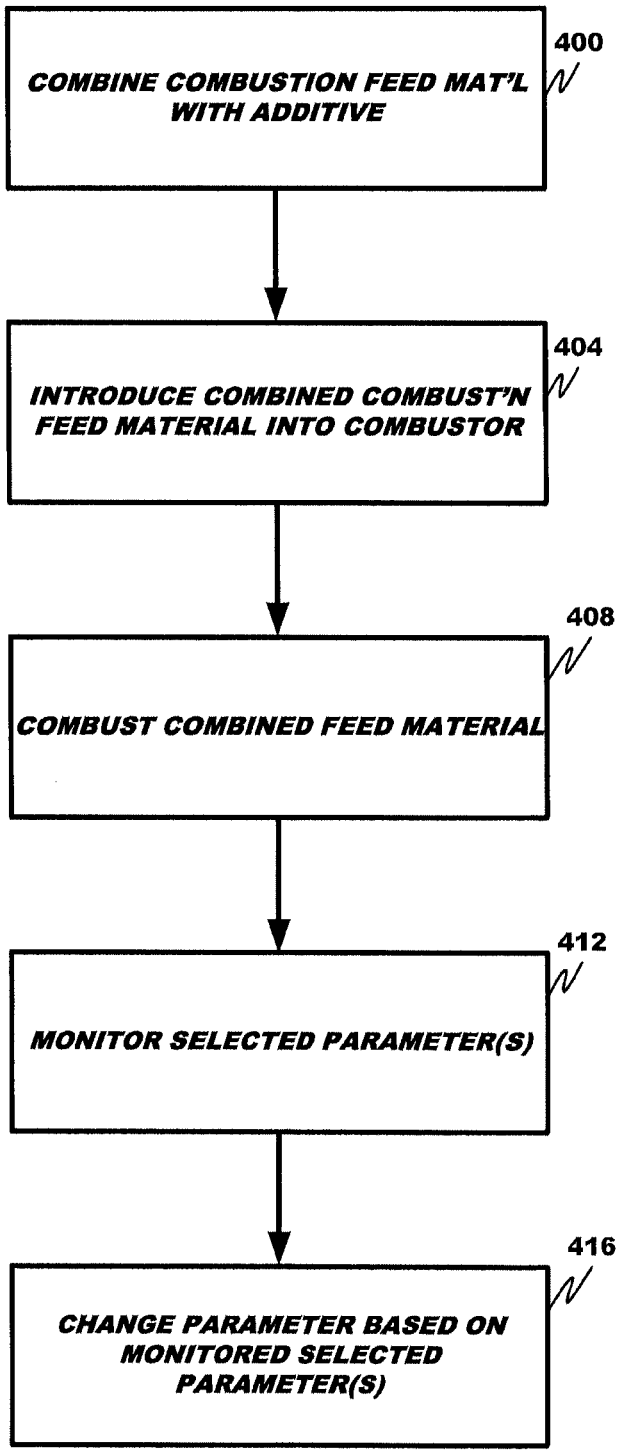
FIG. 4 is a process flow chart according to an embodiment of the disclosure.

A method according to an embodiment of the present disclosure will now be discussed with reference to FIG. 4.

In step 400, the additive 100 is contacted with the combustion feed material 104 to form the combined combustion feed material 108.

In step 404, the combined combustion feed material 108 is introduced into the combustor 112.

In step 408, the combined combustion feed material 108 is combusted in the presence of molecular oxygen, commonly from air introduced into the combustion zone.

In step 412, the combustion and off-gas conditions in or downstream of the combustor 112 are monitored for target contaminant concentration and/or other target off-gas constituent or other parameter(s).

In step 416, one or more selected parameters are changed based on the monitored parameter(s). A number of parameters influence nitrogen oxide and mercury generation and removal. By way of example, one parameter is the rate of introduction of the additive 100. If the rate of addition of additive 100 drops too low, gas phase $NO_X$ levels can increase due to competition between oxidation of additional ammonia and the reaction of ammonia with NO. Another parameter is the gas phase concentration(s) of nitrogen dioxide and/or nitric oxide. Another parameter is the concentration of gas phase molecular oxygen in the mixing zone 204. This parameter controls carbon and additive burnout, $NO_X$ formation, and $SO_X$ capture and decomposition. Another parameter is the temperature in the combustor 112. Higher temperatures in the combustor 112 and lower molecular oxygen concentrations can chemically reduce $NO_X$. Higher combustor temperatures can also decrease gas phase carbon monoxide concentration. Another parameter is gas phase carbon monoxide concentration. Gas phase carbon monoxide concentration in the freeboard zone 208, of the combustor 112 can scavenge radicals and thereby inhibit reactions between the nitrogenous component and $NO_X$. Generally, a negative correlation exists between gas phase CO and NO concentrations; that is, a higher CO concentration indicates a lower NO concentration and vice versa. There further appears to be a negative relationship between gas phase CO concentration and gas phase mercury (total) concentration; that is as CO concentration increases, total mercury concentration decreases. Limestone concentration in the combustor 112 is yet another parameter. Removing catalytic surfaces, such as limestone, can chemically reduce $NO_X$. Gas phase $SO_2$ concentration in the combustor 112 is yet another parameter as it can influence nitrogen oxides. Higher gas phase $SO_2$ concentrations yields a higher gas phase CO concentration, a lower gas phase NO concentration, and higher gas phase nitrous oxide concentration. In CFB combustors, the presence of the nitrogenous component (e.g., urea) makes the fluidized bed zone 200 more reducing so gas phase $SO_2$ concentration increases from decomposition of gypsum, a byproduct of limestone reaction with $SO_X$, and gas phase carbon monoxide concentration increases due to less efficient combustion. Gas phase $SO_2$ concentration increases when limestone flow decreases as well as decreasing NO due to less catalytic surface area. Generally, a negative correlation exists between limestone feed rate and gas phase $SO_2$, CO, and NO concentrations; that is, a higher limestone feed rate indicates lower $SO_2$, CO, and NO concentrations and vice versa. Bed depth and/or bed pressure drop are yet further parameters. These parameters may be controlled by bed drains and control bed temperature; that is a higher pressure drop makes the bed more dense, thereby affecting bed temperature.

Any of these parameters can be changed, or varied (e.g., increased or decreased) to change nitrogen oxide, carbon dioxide, sulfur oxide, and/or mercury emissions in accordance with the relationships set forth above.

Steps 412 and 416 can be implemented manually or by a computerized or automated control feedback circuit using sensors to sense one or more selected parameters, a computer to receive the sensed parameter values and issue appropriate commands, and devices to execute the commands. Microprocessor readable and executable instructions stored on a computer readable medium, such as memory or other data storage, can implement the appropriate control algorithms.

The treated off-gas 132 commonly has substantially reduced levels of nitrogen oxides and mercury compared to the off-gas 116. The additive 100 commonly causes the removal of at least 20% of the gas phase nitrogen oxides and 40% of the elemental mercury generated by combustion of the combustion feed material 104.

Reductions in the amount of a gas phase pollutant are determined in comparison to untreated fuel. Such reductions can be measured in percent, absolute weight or in "fold" reduction. In an embodiment, treatment of fuel with the additive 100 reduces the emission of at least one pollutant by at least about 10%, 20%, 30%, 40%, 50%, 60%, 70%, 80%, 90%, 95% or 100%. In another embodiment, treatment of fuel with the additive 100 reduces the emission of at least one pollutant by two-fold, three-fold, four-fold, five-fold, or ten-fold. In another embodiment, treatment of fuel with the additive reduces the emission of one or more of $NO_X$ and total mercury to less than about 500 ppmv, 250 ppmv, 100 ppmv, 50 ppmv, 25 ppmv, 10 ppmv, 5 ppmv, 4 ppmv, 3 ppmv, 2 ppmv, 1 ppmv, 0.1 ppmv, or 0.01 ppmv. As noted, the pollutant is one or both of nitrogen oxides and total or elemental mercury.

It should be appreciated that the terms amount, level, concentration, and the like, can be used interchangeably. Amounts can be measured in, for example, parts per million (ppm), or in absolute weight (e.g., grams, pounds, etc.) Methods of determining amounts of pollutants present in a flue gas are known to those skilled in the art.

EXPERIMENTAL

The following examples are provided to illustrate certain aspects, embodiments, and configurations of the disclosure and are not to be construed as limitations on the disclosure, as set forth in the appended claims. All parts and percentages are by weight unless otherwise specified.

Figure 5:
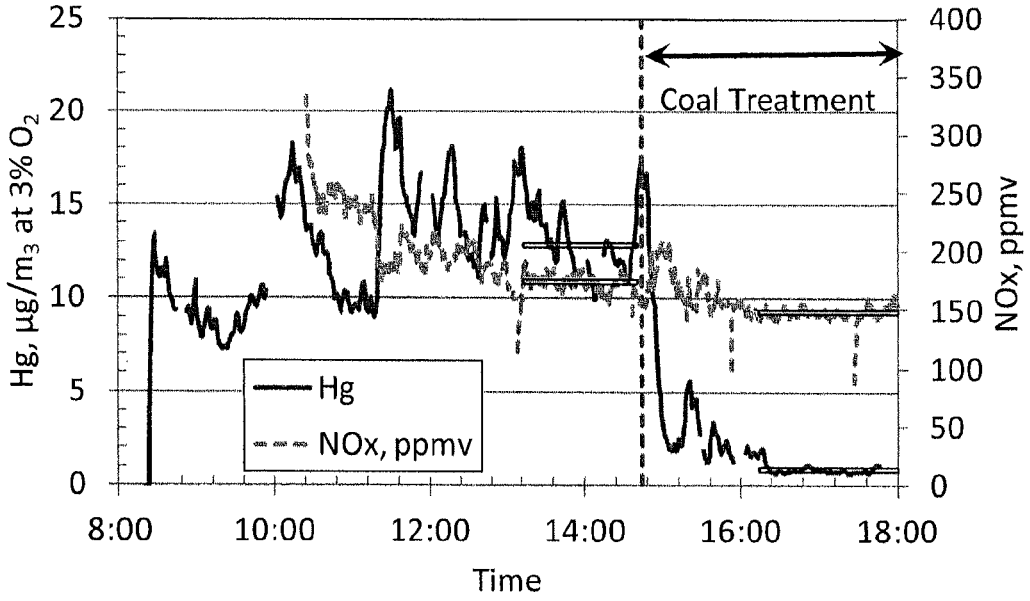
FIG. 5 is a record of the emissions of mercury (Hg) and nitrogen oxides ($NO_x$) measured at the baghouse exit of a small-scale CFB combustor.

In preliminary testing, coal additives were tested at a small-scale circulating fluidized bed (CFB) combustor. Coal was treated by mixing solid urea with crushed coal and by spraying an aqueous solution containing potassium iodide onto crushed coal. Coal was fed into the combustion chamber by means of a screw feeder at a rate of approximately 99 lb/hr. Limestone was not fed continuously but added batchwise to the bed. The only air pollution control device on the combustor was a fabric filter baghouse. The concentrations of nitrogen oxides ($NO_x$) and total gaseous mercury were measured in gas at the baghouse exit using continuous emission monitors (CEMs). The treatment rate of the coal corresponded to 0.0069 lb urea/lb coal and 0.000007 lb iodine/lb coal. The ratio of nitrogen to iodine added on a mass basis was 460 lb nitrogen per lb iodine. FIG. 5 is a record of the emissions of mercury (Hg) and nitrogen oxides ($NO_x$) measured at the baghouse exit during two periods: before the treated coal was added to the boiler and during combustion of the treated coal. The vertical dotted line indicates the time at which the coal started to be treated with the additives. During the baseline (no treatment period), the average emissions of $NO_x$ and Hg were 175 ppmv and 12.9 $\mu g/m^3$, respectively. During a steady-state period of coal treatment, average emissions of $NO_x$ and Hg were 149 ppmv and 0.8 $\mu g/m^3$, respectively. Comparing these two periods, the reductions in $NO_x$ and Hg due to the coal treatment were 14.5% and 93.5%, respectively.

Figure 6:
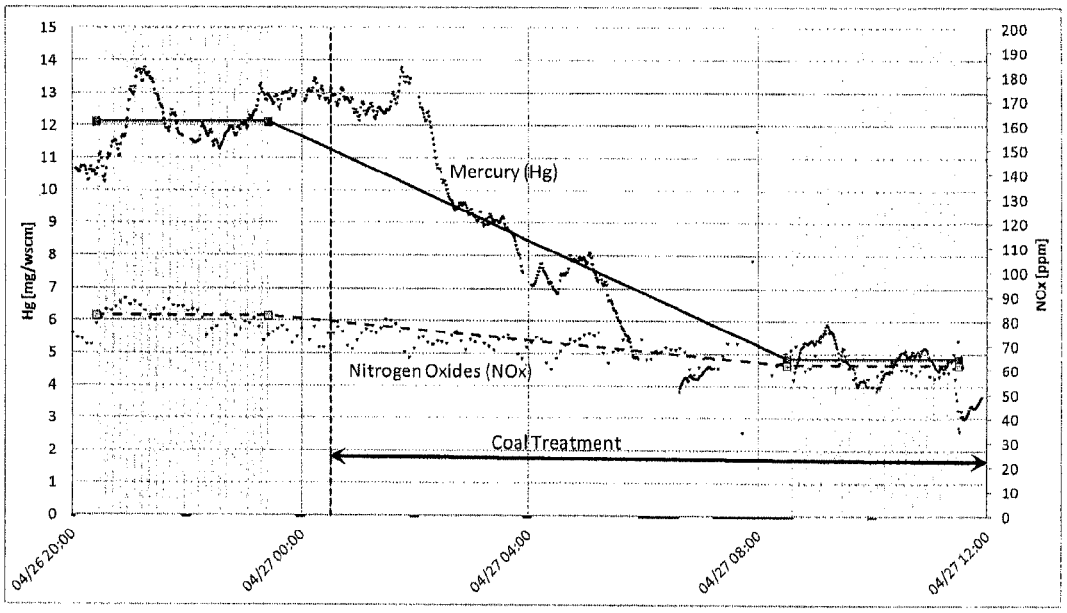
FIG. 6 is a record of the emissions of mercury (Hg) and nitrogen oxides ($NO_x$) measured at the stack of a CFB boiler.

Coal additives were tested at a circulating fluidized bed (CFB) boiler. Coal was treated by adding solid urea prill and by spraying an aqueous solution containing potassium iodide onto the coal belt between the coal crusher and the silos. Coal was fed from the silos directly into the boiler. The boiler burned approximately 190 tons per hour of coal. Limestone was fed into the bed at a rate of approximately 12 tons per hour. The only air pollution control device on the boiler was a fabric filter baghouse. The concentrations of nitrogen oxides ($NO_x$) and total gaseous mercury were measured in the stack using continuous emission monitors (CEMs). The treatment rate of the coal corresponded to 0.0025 lb urea/lb coal and 0.000005 lb iodine/lb coal. The ratio of nitrogen to iodine added on a mass basis was 233 lb nitrogen per lb iodine. FIG. 6 is a record of the emissions of mercury (Hg) and nitrogen oxides ($NO_x$) measured at the stack during two periods: before the treated coal was added to the boiler and during combustion of the treated coal. The vertical dotted line indicates the time at which the coal started to be treated with the additives. The shaded region on the left-hand side of the graph in FIG. 5 represents the baseline (no treatment period), with average emissions of $NO_x$ and Hg of 82.2 ppmv and 12.1 $\mu g/m^3$, respectively. The shaded region on the right-hand-side of the graph represents the steady-state emissions from treated coal, with average emissions of $NO_X$ and Hg of 62.2 ppmv and 4.9 $\mu g/m^3$, respectively. Comparing these two periods, the reductions in $NO_X$ and Hg due to the coal treatment were 24.3% and 60%, respectively.

In another embodiment of the technology, coal additives were tested at a circulating CFB boiler. Coal was treated by spraying a solution consisting of 50% urea in water and by spraying an aqueous solution containing potassium iodide onto the coal belt between the coal crusher and the silos. Coal was fed from the silos directly into the boiler. The boiler burned approximately 210 tons per hour of coal. Limestone was fed into the bed at a rate of approximately 16 tons per hour. The only air pollution control device on the boiler was a fabric filter baghouse. The concentrations of nitrogen oxides ($NO_x$) and total gaseous mercury were measured in the stack using continuous emission monitors (CEMs). The treatment rate of the coal corresponded to 0.0040 lb urea/lb coal and 0.000007 lb iodine/lb coal. The ratio of nitrogen to iodine added on a mass basis was 266 lb nitrogen per lb iodine. During the baseline (no treatment period), the average emissions of $NO_x$ and Hg were 85.2 ppmv and 14.8 $\mu g/m^3$, respectively. During a steady-state period of coal treatment, average emissions of $NO_x$ and Hg were 58.9 ppmv and 7.1 $\mu g/m^3$, respectively. Comparing these two periods, the reductions in $NO_x$ and Hg due to the coal treatment were 30.9% and 51.9%, respectively.

A number of variations and modifications of the disclosure can be used. It would be possible to provide for some features of the disclosure without providing others. The present disclosure, in various aspects, embodiments, and configurations, includes components, methods, processes, systems and/or apparatus substantially as depicted and described herein, including various aspects, embodiments, configurations, subcombinations, and subsets thereof. Those of skill in the art will understand how to make and use the various aspects, aspects, embodiments, and configurations, after understanding the present disclosure. The present disclosure, in various aspects, embodiments, and configurations, includes providing devices and processes in the absence of items not depicted and/or described herein or in various aspects, embodiments, and configurations hereof, including in the absence of such items as may have been used in previous devices or processes, e.g., for improving performance, achieving ease and\or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more, aspects, embodiments, and configurations for the purpose of streamlining the disclosure. The features of the aspects, embodiments, and configurations of the disclosure may be combined in alternate aspects, embodiments, and configurations other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed aspects, embodiments, and configurations. Thus, the following claims are hereby incorporated into this Detailed Description, with each claim standing on its own as a separate preferred embodiment of the disclosure.

Moreover, though the description of the disclosure has included description of one or more aspects, embodiments, or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A flue gas additive, comprising:

a nitrogenous material that forms ammonia when combusted, wherein the nitrogenous material comprises one or more of an amine and amide; and a halogen-containing material that forms a gas phase halogen when combusted.

2. The flue gas additive of claim 1, wherein the nitrogenous material comprises urea.

3. The flue gas additive of claim 1, wherein the halogen in the halogen-containing material is one or more of iodine and bromine.

4. The flue gas additive of claim 1, wherein a mass ratio of the nitrogen content of the nitrogenous material to the halogen content in the halogen-containing material in the additive commonly ranges from about 1:1 to about 2,400:1.

5. The flue gas additive of claim 1, wherein the flue gas additive is in the form of a liquid in a liquid carrier and wherein a concentration of the nitrogenous material in the liquid carrier ranges from about 20 to about 60 wt. %.

6. The flue gas additive of claim 1, wherein, when the additive added to a gas stream comprising nitrogen oxides, an amount of the flue gas additive is added to the gas stream to form a normalized stoichiometric ratio (NSR) of ammonia to nitrogen oxides of about 1 to about 3.

7. A flue gas additive, comprising:

a nitrogenous material that forms ammonia when combusted; and a halogen-containing material that forms a gas phase halogen when combusted, wherein the additive is supported by a particulate substrate that is one or more of a combustion feed material, a zeolite, porous metal silicate material, clay, activated carbon, char, graphite, ash, metal, and metal oxide.

8. A flue gas additive, comprising:

a nitrogenous material that forms ammonia when combusted; and a halogen-containing material that forms a gas phase halogen when combusted, wherein the additive is unsupported and in the form of a free-flowing particulate having a $P_{80}$ size ranging from about 6 to about 20 mesh (Tyler).

9. A flue gas additive, comprising:

a nitrogenous material that forms ammonia when combusted; and a halogen-containing material that forms a gas phase halogen when combusted, wherein the flue gas additive is mixed with coal to form a combined combustion feed material and wherein the combined combustion feed material comprises from about 0.05 to about 0.5 wt. % of the flue gas additive, with the remainder being coal.

10. A flue gas additive, comprising:

a nitrogenous material that forms ammonia when combusted; and a halogen-containing material that forms a gas phase halogen when combusted, wherein the flue gas additive is mixed with coal to form a combined combustion feed material, wherein the flue gas additive comprises a coating to impede thermal degradation and/or decomposition of the nitrogenous material and wherein the combined combustion feed material comprises from about 0.05 to about 0.5 wt. % of the flue gas additive, with the remainder being coal.

11. A combined combustion feed material comprising a nitrogenous material for reducing nitrogen oxides, coal, and a halogen-containing material that forms a gas phase halogen when combusted.

12. The combined combustion feed material of claim 11, wherein the combined weight of the nitrogenous and halogen-containing materials comprises from about 0.05 to about 1 wt. % of the combined combustion feed material, with the remainder being coal.

13. The combined combustion feed material of claim 11, wherein the nitrogenous material is at least one of an amine and amide and wherein the coal is at least one of a high alkali coal, high iron coal, and high sulfur coal.

14. The combined combustion feed material of claim 11, wherein the combined combustion feed material comprises a mass ratio of nitrogen from the nitrogenous material to the mass of:halogen from the halogen-containing material ranges from about 1:1 to about 2400:1.

15. A flue gas additive, comprising:

a nitrogenous material that forms ammonia when combusted; and a halogen-containing material that forms a gas phase halogen when combusted, wherein the flue gas additive comprises from about 0.05 to about 1 wt. % of the nitrogenous additive and wherein a mass ratio of the nitrogen content of the nitrogenous material to the halogen content in the halogen-containing material ranges from about 1:1 to about 2400:1.

16. A flue gas additive, comprising:

a urea; and a halogen-containing material that forms a gas phase halogen when combusted, wherein the urea is a polymerized methylene urea and wherein the halogen in the halogen-containing material is iodine.

17. The flue gas additive of claim 16, further comprising:

a liquid carrier, wherein the flue gas additive is in the form of a liquid and wherein an amount of the nitrogenous material in the liquid carrier ranges from about 20 to about 60 wt. %.

18. A flue gas additive, comprising: a urea and a halogen-containing material that forms a gas phase halogen when combusted, wherein the flue gas additive is supported by a particulate substrate that is one or more of a combustion feed material, a zeolite, porous metal silicate material, clay, activated carbon, char, graphite, ash, metal, and metal oxide.

19. A flue gas additive, comprising: a urea and a halogen-containing material that forms a gas phase halogen when combusted, wherein the flue gas additive is unsupported and in the form of a free-flowing particulate having a $P_{80}$ size ranging from about 6 to about 20 mesh (Tyler).

20. A flue gas additive, comprising: a urea and a halogen-containing material that forms a gas phase halogen when combusted, wherein the urea and the halogen-containing material are mixed with coal and wherein the urea and the halogen-containing material together comprise from about 0.05 to about 0.5 wt. % of the flue gas additive, with the remainder being coal.

* * * * *